US008720005B2

(12) United States Patent
Cheng

(10) Patent No.: US 8,720,005 B2
(45) Date of Patent: May 13, 2014

(54) HYDRAULIC HINGE FOR A GLASS DOOR

(71) Applicant: Gang GWO Industrial Co., Ltd., Pingtung (TW)

(72) Inventor: Ko-Ming Cheng, Pingtung (TW)

(73) Assignee: Gang Gwo Industrial Co., Ltd., Pingtung, Pingtung County (TW)

( * ) Notice: Subject to any disclaimer, the term of this patent is extended or adjusted under 35 U.S.C. 154(b) by 0 days.

(21) Appl. No.: 13/715,038

(22) Filed: Dec. 14, 2012

(65) Prior Publication Data

US 2013/0160238 A1 Jun. 27, 2013

(30) Foreign Application Priority Data

Dec. 21, 2011 (TW) ..... 100147609 A

(51) Int. Cl.

| | |
|---|---|
| ***E05F 3/20*** | (2006.01) |
| ***E05D 5/02*** | (2006.01) |
| ***E05D 11/10*** | (2006.01) |
| ***E05D 5/00*** | (2006.01) |

(52) U.S. Cl.
USPC ..... 16/54; 16/252

(58) Field of Classification Search
USPC ..... 16/252, 334, 335, 286, 54, 50; 4/556, 4/557, 607, 610; 49/381, 397, 398, 386
See application file for complete search history.

(56) References Cited

U.S. PATENT DOCUMENTS

| | | | | |
|---|---|---|---|---|
| 5,079,798 | A * | 1/1992 | Burke et al. | 16/252 |
| 5,297,313 | A * | 3/1994 | Brin | 16/252 |
| 5,867,869 | A * | 2/1999 | Garrett et al. | 16/252 |
| 6,161,255 | A * | 12/2000 | Garrett | 16/284 |
| 6,519,811 | B1 * | 2/2003 | Cheng | 16/252 |
| 6,560,821 | B2 * | 5/2003 | Miller et al. | 16/252 |
| 6,704,966 | B1 * | 3/2004 | Kao | 16/252 |
| 6,766,561 | B1 * | 7/2004 | Cheng | 16/235 |
| 6,925,685 | B2 * | 8/2005 | Chen | 16/332 |
| 6,966,150 | B2 * | 11/2005 | Chiang | 49/388 |

(Continued)

FOREIGN PATENT DOCUMENTS

| | | | |
|---|---|---|---|
| AU | 2010100487 A4 | * | 7/2010 |
| CN | 201110071 Y | * | 9/2008 |

(Continued)

OTHER PUBLICATIONS

AU 2010100487 A4 Derwent Abstract.*

(Continued)

*Primary Examiner* — Victor Batson
*Assistant Examiner* — Jason W San
(74) *Attorney, Agent, or Firm* — patenttm.us

(57) ABSTRACT

A hydraulic hinge for a glass door has a fixing plate, a base, a pivot, a buffer module, and a clamping module. The base is combined with the fixing plate and has an oil passage. The oil passage is formed in the base. The pivot is rotatably mounted in the base and has an adjusting space communicating with the oil passage. The oil passage and the adjusting space are filled with oil. The buffer module is mounted in the base and has a sliding tube abutting the pivot. The clamping module is pivotally mounted on the pivot and can clamp a glass door. The glass door can be pivoted relative to the base. With the buffer module and the oil in the oil passage, the glass door can be closed in a smooth movement.

8 Claims, 10 Drawing Sheets

(56) References Cited

U.S. PATENT DOCUMENTS

| | | | | |
|---|---|---|---|---|
| 7,010,832 | B2 * | 3/2006 | Chen | 16/252 |
| 7,114,292 | B2 * | 10/2006 | Chiang | 49/388 |
| 7,188,390 | B2 * | 3/2007 | Cheng | 16/252 |
| 7,305,797 | B2 * | 12/2007 | Chiang | 49/388 |
| 8,528,169 | B1 * | 9/2013 | Yu | 16/51 |
| 8,539,643 | B2 * | 9/2013 | Hung | 16/252 |
| 2005/0050685 | A1 * | 3/2005 | Chen | 16/332 |
| 2005/0144757 | A1 * | 7/2005 | Chiang | 16/252 |
| 2008/0168621 | A1 * | 7/2008 | Lin | 16/252 |
| 2012/0079682 | A1 * | 4/2012 | Cheng | 16/252 |
| 2012/0091867 | A1 * | 4/2012 | Bouwman | 312/116 |
| 2012/0216370 | A1 * | 8/2012 | Chow | 16/54 |
| 2013/0160238 | A1 * | 6/2013 | Cheng | 16/54 |

FOREIGN PATENT DOCUMENTS

| | | | |
|---|---|---|---|
| EP | 409445 | A1 * | 1/1991 |
| EP | 2472036 | A2 * | 7/2012 |
| ES | 1073873 | U * | 2/2011 |

OTHER PUBLICATIONS

ES 1073862 U Machine Translation.*
ES1073873U Machine Translation.*
ES1073873U Derwent Abstract.*

* cited by examiner

HYDRAULIC HINGE FOR A GLASS DOOR

BACKGROUND OF THE INVENTION

1. Field of the Invention

The present invention relates to a hydraulic hinge, especially for a hydraulic hinge for a glass door.

2. Description of Related Art

A glass door is mounted in a doorframe by a hinge, such that the glass door can be pivoted relative to the doorframe.

A conventional hinge has a fixing plate, a base, a pivot, and two clamping plates. The fixing plate is combined with a doorframe. The base is combined with the fixing plate. The base has a first space, a second space, a stick, and a spring. The first space and the second space are formed in the base and communicate with each other. The stick is mounted in the first space. The spring is mounted around the stick to make the stick moveable in the first space. The pivot is mounted in the second space and abuts the stick. The pivot has two opposite cambered surfaces and two opposite flat surfaces. The pivot abuts the stick by one of the cambered surfaces or one of the flat surfaces. The clamping plates are mounted on the ends of the pivot and can be pivoted relative to the base. A glass door is clamped between the clamping plates.

When the glass door is pivoted, the clamping plates are rotated relative to the base. The pivot abuts the stick by one of the cambered surfaces or one of the flat surfaces, such that the degree of compression of the spring varies depending on the abutting angle of the pivot on the cambered surface or the flat surface, and then the pivot can be pivoted smoothly. However, the conventional hinge lacks a buffer device, so the closing of the glass door cannot be processed in a slow and smooth movement.

SUMMARY OF THE INVENTION

The main object of the present invention is to provide a hydraulic hinge for a glass door, which has a fixing plate, a base, a pivot, a buffer module, and a clamping module.

The base is combined with the fixing plate and has a top side, a bottom side, a front side, a rear side, a right side, a left side, a longitudinal direction form the top side to the bottom side, a lateral direction from the front side to the rear side, a first space formed in the base and along the longitudinal direction, a second space formed in the base and along the lateral direction, and an oil passage formed in the base and communicating with the first space and the second space. The oil passage has a first passage formed in the base and communicating with the first space, and a second passage formed in the base and communicating with the first passage and the second space.

The pivot is rotatably mounted in the first space and has a side, an abutted surface formed in the pivot, and an adjusting space formed in the side of the pivot and adjacent to the abutted surface and communicating with the oil passage.

The buffer module is mounted in the second space and has a fixed cover mounted in and sealing the second space and adjacent to the fixing plate, a sliding tube slidably mounted in the second space and abutting the pivot, and a spring mounted between and abutting the fixed cover and the sliding tube. The sliding tube further has an end abutting the pivot, and an assembling portion formed in the end of the sliding tube abutting the pivot and selectively communicating between the second space and the adjusting space.

The clamping module is pivotally mounted on the pivot and has two clamping plates pivotally and respectively mounted on the right side and the left side of the base.

The hydraulic hinge is mounted on a doorframe. The clamping module is applied for clamping a glass door, such that the glass door can be pivoted relative to the doorframe.

When the glass door is pivoted to be in an open condition, the glass door drives the pivot to rotate, and then the abutted surface does not abut the sliding tube, and the pivot pushes the sliding tube to move towards the fixing cover. The space between the sliding tube and the fixing cover is reduced gradually, and the oil in the adjusting space flows into the oil passage.

The sliding tube is pushed by the spring to move towards the pivot, such that the space between the fixing cover and the sliding tube is increased, and the oil in the oil passage flows into the second space. The sliding tube pushes the pivot to rotate to make the abutted surface face the fixing cover and abut the sliding tube again, such that the glass door is in a closed condition again. As a result, the glass door can be closed in a slow and smooth movement.

DETAILED DESCRIPTION OF PREFERRED EMBODIMENT

Figure 1:
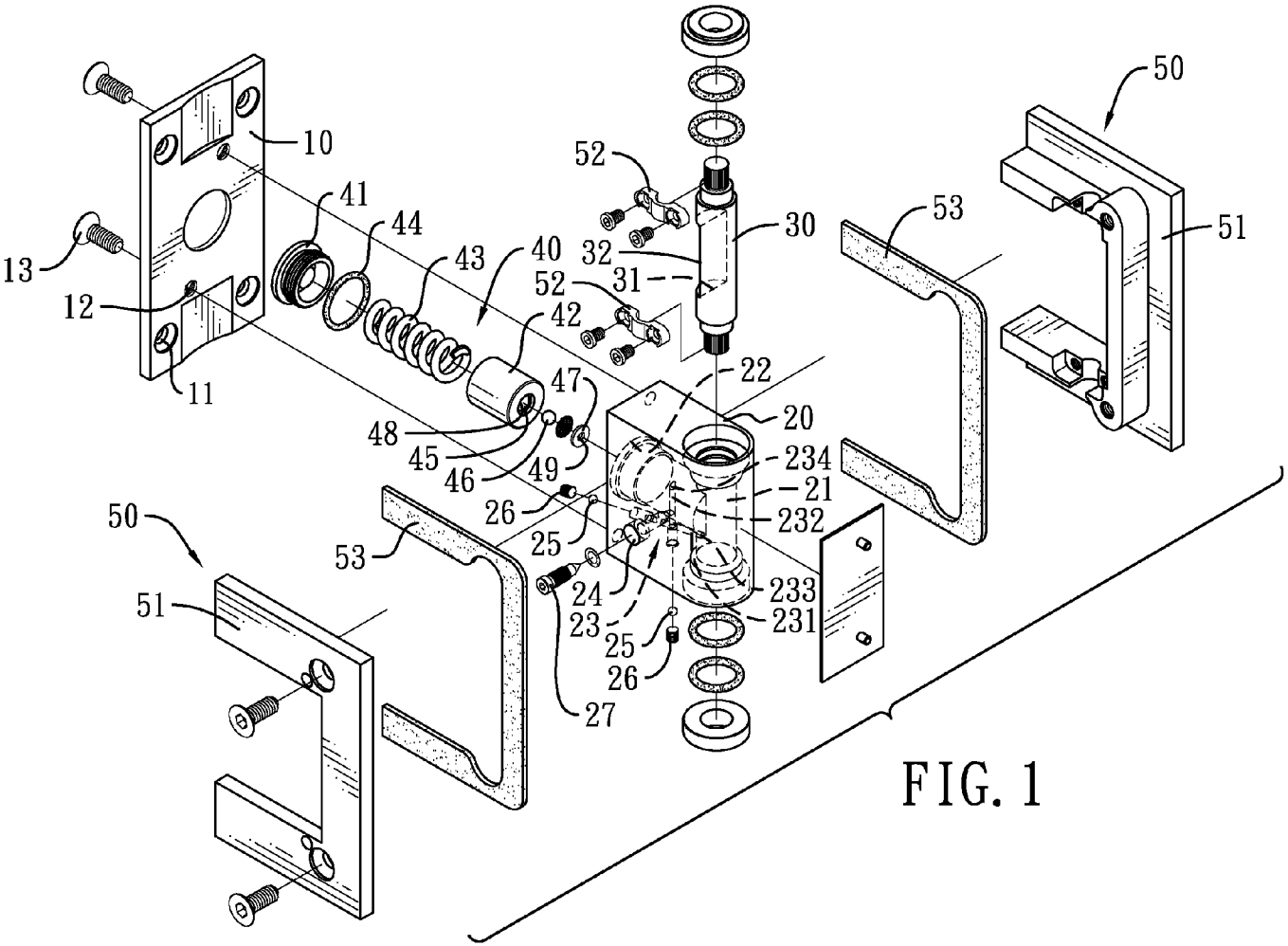
FIG. 1 is an exploded perspective view of a first preferred embodiment of a hydraulic hinge for a glass door in accordance with the present invention.
Figure 2:
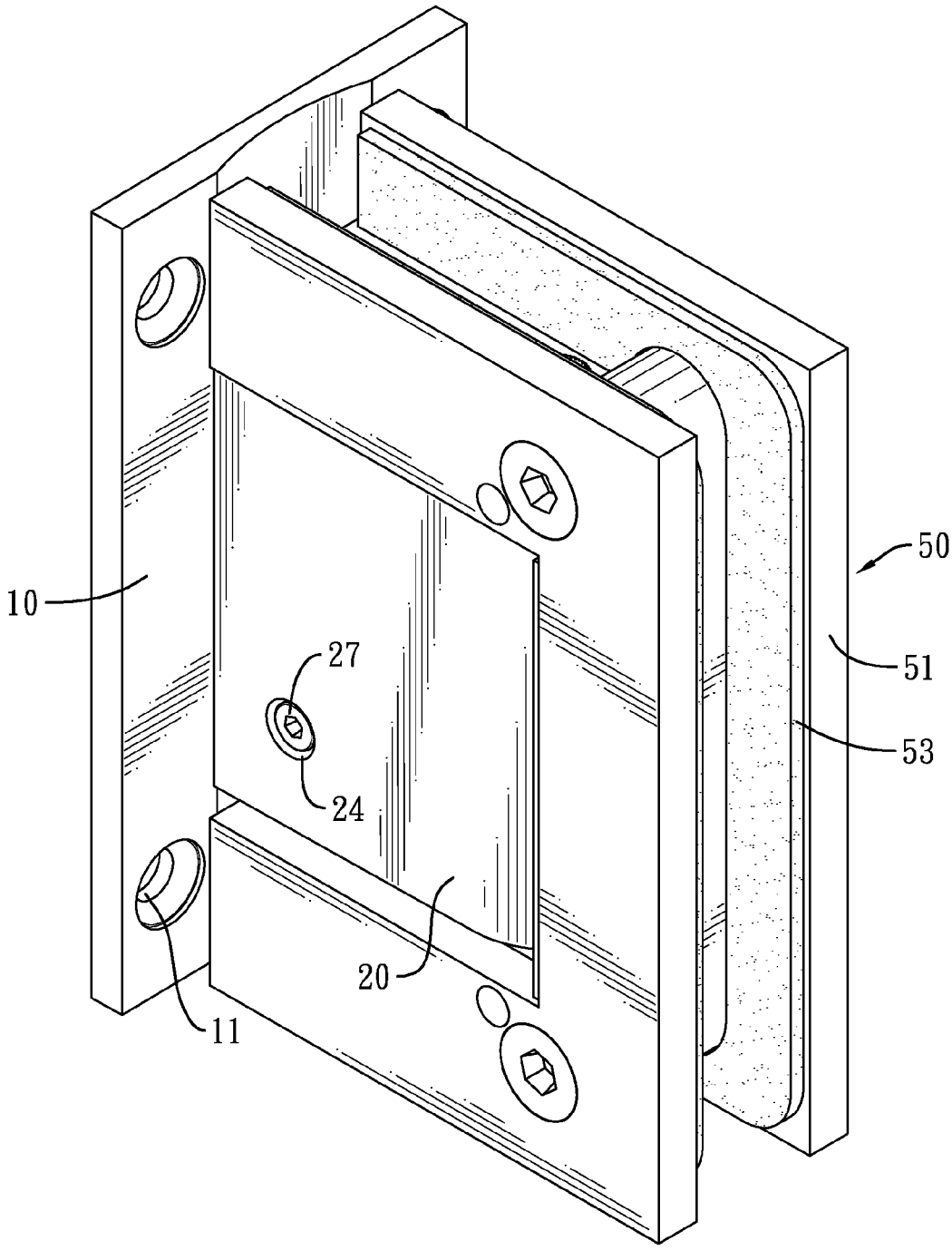
FIG. 2 is a perspective view of the hydraulic hinge in FIG. 1.
Figure 3:
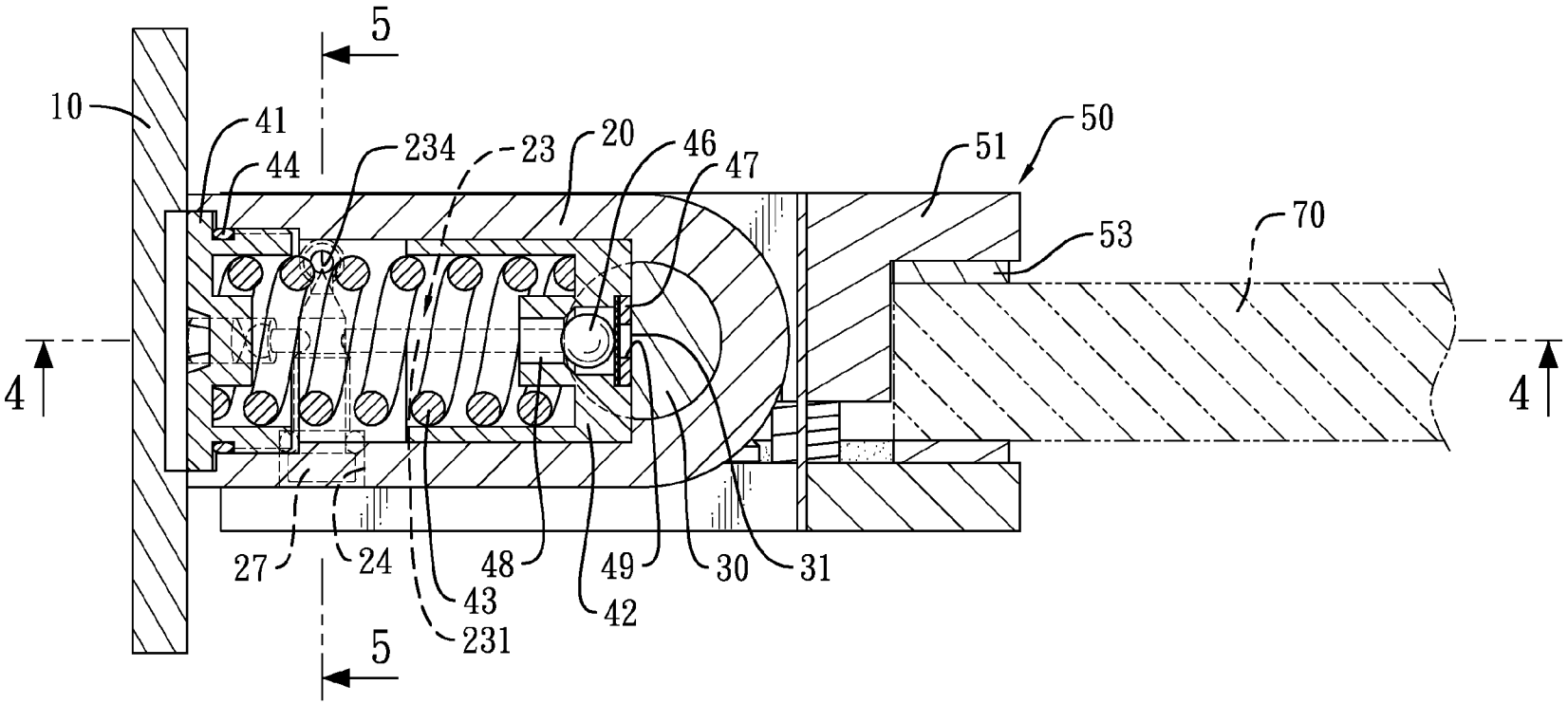
FIG. 3 is an enlarged operational top view in partial section of the hydraulic hinge in FIG. 1.

With reference to FIG. 1 and FIG. 2, a first preferred embodiment of a hydraulic hinge for a glass door in accordance with the present invention has a fixing plate 10, a base 20, a pivot 30, a buffer module 40, and a clamping module 50. With further reference to FIG. 3, the hydraulic hinge is applied for clamping a glass door 70, and the hydraulic hinge is mounted on a doorframe, such that the glass door 70 can be pivoted relative to the doorframe.

With reference to FIG. 1 to FIG. 3, the fixing plate 10 has multiple plate holes 11, multiple fixing holes 12, and multiple bolts 13. The plate holes 11 are formed in the fixing plate 10, and the fixing plate 10 can be fixed on the doorframe by multiple fixing units mounted through the plate holes 11 respectively and combined with the doorframe. The fixing holes 12 are formed in the fixing plate 10 and the bolts 13 are mounted through and protrude from the fixing holes 12 respectively.

The base 20 is made of stainless steel to provide an antirust effect and is combined with the fixing plate 10 by the bolts 13. The base 20 has a top side, a bottom side, a front side, a rear side, a right side, a left side, a longitudinal direction, a lateral direction, a first space 21, a second space 22, an oil passage 23, and an adjusting hole 24. The longitudinal direction is defined from the top side to the bottom side. The lateral direction is defined from the front side to the rear side. The first space 21 is formed in the base 20 along the longitudinal direction. The second space 22 is formed in the base 20 along the lateral direction and communicates with the first space 21.

The oil passage 23 is formed in the base 20 and communicates with the first space 21 and the second space 22. The oil passage 23 is filled with oil. The oil passage 23 has a first passage 231 and a second passage 232. The first passage 231 and the second passage 232 are formed in the base 20 and communicate with each other. The first oil passage 231 has a first space opening 233 formed on an end of the first passage 231, such that the first passage 231 can communicate with the first space 21 through the first opening 233. The second passage 232 has a second space opening 234 formed on an end of the second passage 232, such that the second passage 232 can communicate with the second space 22 through the second space opening 234. The adjusting hole 24 is formed in the base 20 and communicates with the oil passage 23.

Preferably, the first passage 231 further has a first opening, a first narrow segment and a first wide segment, and the second passage 232 further has a second opening, a second narrow segment and a second wide segment. The first opening is formed on an end of the first passage 231 opposite to the first space opening 233 and on the outer surface of the base 20. The first narrow segment communicates with the first space 21, and the first wide segment is connected between the first narrow segment and the first opening. The second opening is formed on an end of the second passage 232 opposite to the second space opening 234 and on the outer surface of the base 20. The second narrow segment communicates with the second space 22, and the second wide segment is connected between the second narrow segment and the second opening. The base 20 further has two stopping balls 25 and two stopping units 26. One of the stopping balls 25 is mounted in the first wide segment of the first passage 231 and seals the junction of the first wide segment and the first narrow segment, and the other stopping ball 25 is mounted in the second wide segment and seals the junction of the second wide segment and the second narrow segment. One of the stopping units 26 is mounted in the first wide segment to fix in position the stopping ball 25 which is mounted in first wide segment, and the other stopping unit 26 is mounted in the second wide segment to fix in position the stopping ball 25 which is mounted in the second wide augment. As a result, only the first narrow segment and the second narrow segment are filled with oil, and the oil is prevented from pouring out of the base 20.

Preferably, the base 20 further has an adjusting unit 27 moveably mounted in the adjusting hole 24. The adjusting unit 27 can be screwed out of or into the adjusting hole 24 to determine the size of the space that is a sum of the oil passage 23 and the adjusting hole 24, such that the hydraulic hinge can control the flow speed of the oil in the oil passage 23 and the adjusting hole 24 by adjusting the position of the adjusting unit 27 in the adjusting hole 24.

The pivot 30 is rotatably mounted in the first space 21 and has an abutted surface 31 and an adjusting space 32. The abutted surface 31 is formed in the pivot 30. The adjusting space 32 is formed in a side of the pivot 30 and is adjacent to the abutted surface 31. The adjusting space 32 can communicate with the oil passage 23 when the pivot 30 is rotated to make the abutted surface 31 face the second space 22. The adjusting space 32 is filled with oil.

The buffer module 40 is mounted in the second space 22 and has a fixed cover 41, a sliding tube 42, a spring 43, a sealing ring 44, and an assembling portion 45. The fixed cover 41 is mounted in and seals the second space 22 and is adjacent to the fixing plate 10. The sliding tube 42 is slidably mounted in the second space 22 and abuts the pivot 30. The spring 43 is mounted between and abuts the fixed cover 41 and the sliding tube 42. The sealing ring 44 is mounted around the fixed cover 41.

The assembling portion 45 is mounted on an end of the sliding tube 42 that abuts the pivot 30. The assembling portion 45 has a ball 46 and a filtering plate 47, a tube hole 48, and a plate hole 49. The ball 46 and the filtering plate 47 are mounted in the assembling portion 45 to form a control valve, and the sliding tube 42 can use the control valve to selectively seal the end of the sliding tube 42 that abuts the pivot 30. The tube hole 48 is formed in the assembling portion 45. The ball 46 is moveably mounted in and selectively seals the tube hole 48. The filtering plate 47 is mounted in the tube hole 48 and selectively abuts the pivot 30. The plate hole 49 is formed in the filtering plate 47 and aligned with the tube hole 48.

The clamping module 50 is mounted on the right side and the left side of the base 20 and pivotally connected with the pivot 30. Preferably, the clamping module 50 has two clamping plates 51, two clamping units 52, and two clamping pads 53. The clamping plates 51 are made of stainless steel to provide an antirust effect. One of the clamping plates 51 is pivotally connected with the pivot 30 by the clamping units 52, wherein the clamping units 52 are mounted on two ends of the pivot 30 respectively. The other clamping plate 51 is combined on a side of the clamping plate 51 with which the pivot 30 is connected. The clamping pads 53 are mounted on the clamping plates 51 and located on the right side and the left side of the base 20 respectively. The clamping module 50 can clamp a glass door, such that the glass door can be pivotally connected with a doorframe by the hydraulic hinge.

Figure 4:
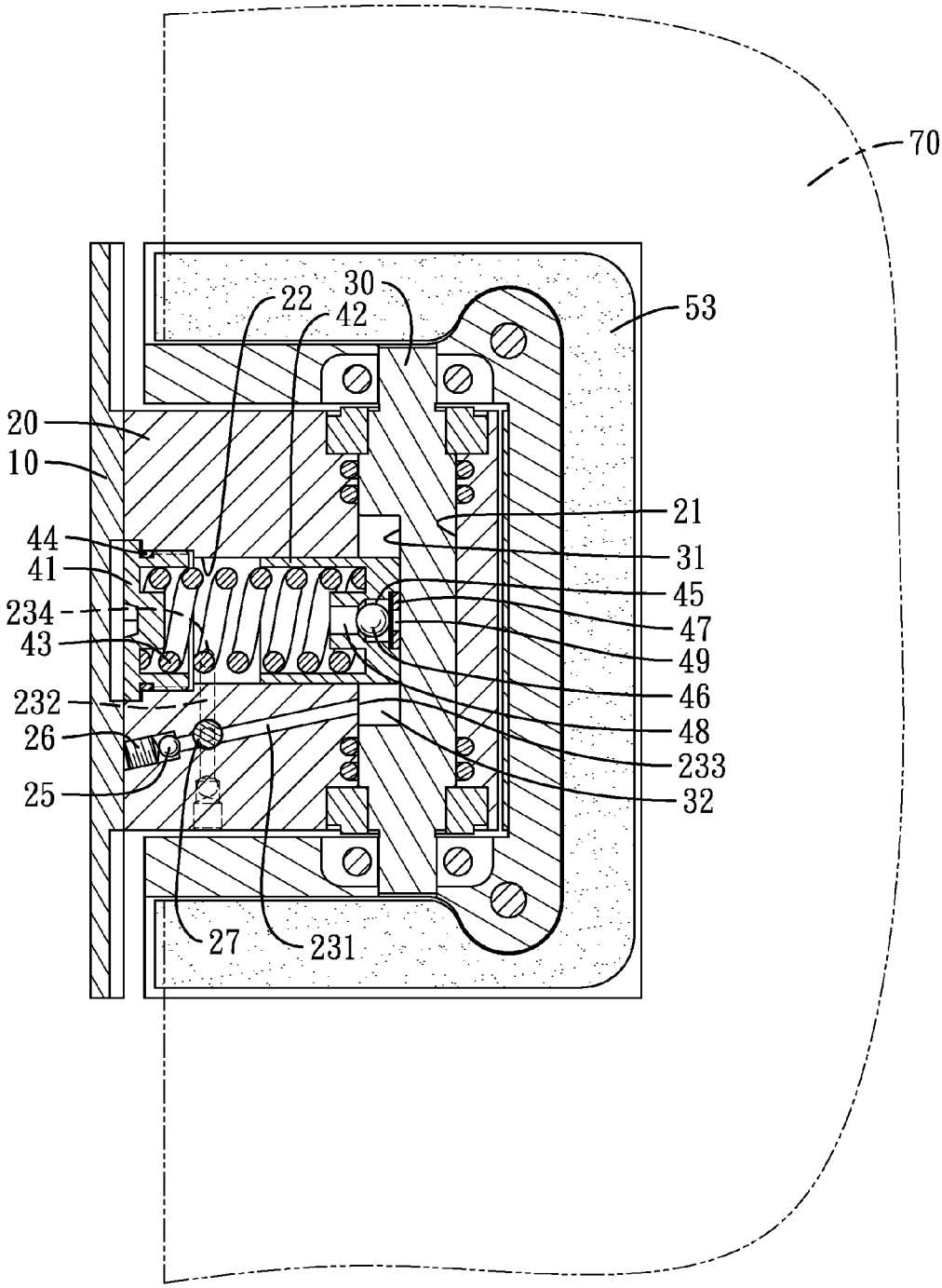
FIG. 4 is an operational left side view in partial section of the hydraulic hinge along line 4-4 in FIG. 3.
Figure 5:
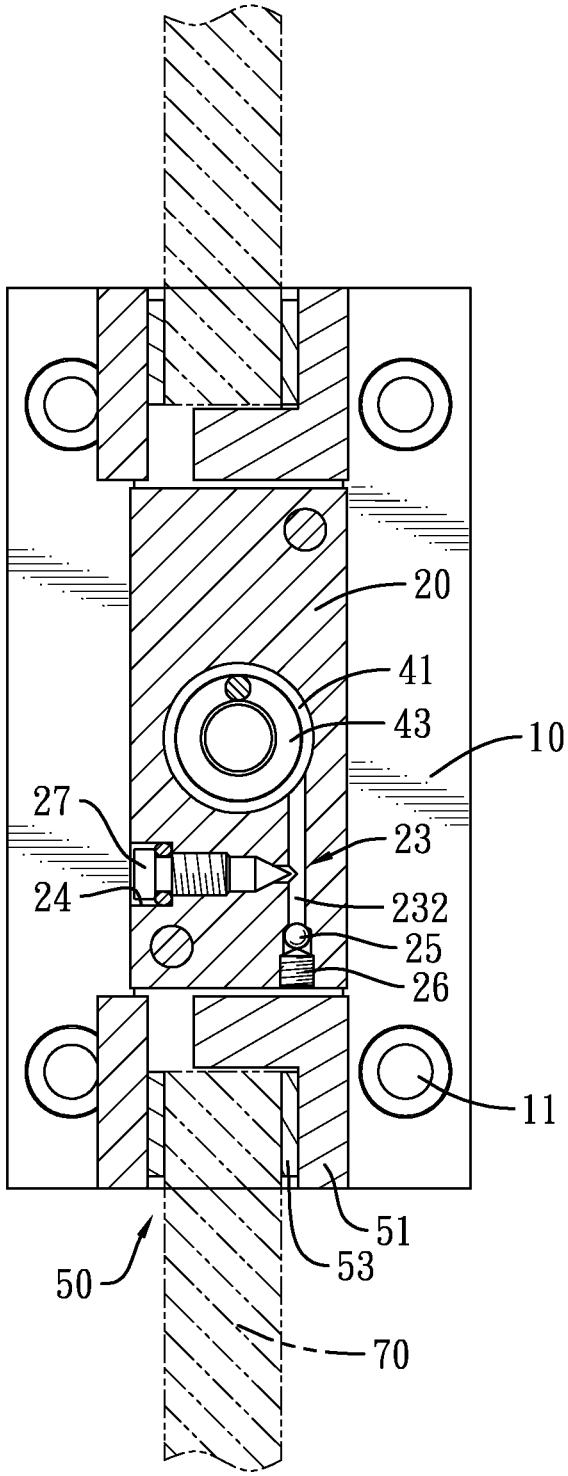
FIG. 5 is an operational front view in partial section of the hydraulic hinge along line 5-5 in FIG. 3.

With reference to FIG. 3 to FIG. 5, a glass door 70 is clamped between the clamping pads 53. When the glass door 70 is in a closed situation, which means an angle between the glass door 70 and the base 20 is 180 degrees, the sliding tube 42 protrudes into the adjusting space 32 and abuts the abutted surface 31.

Figure 6:
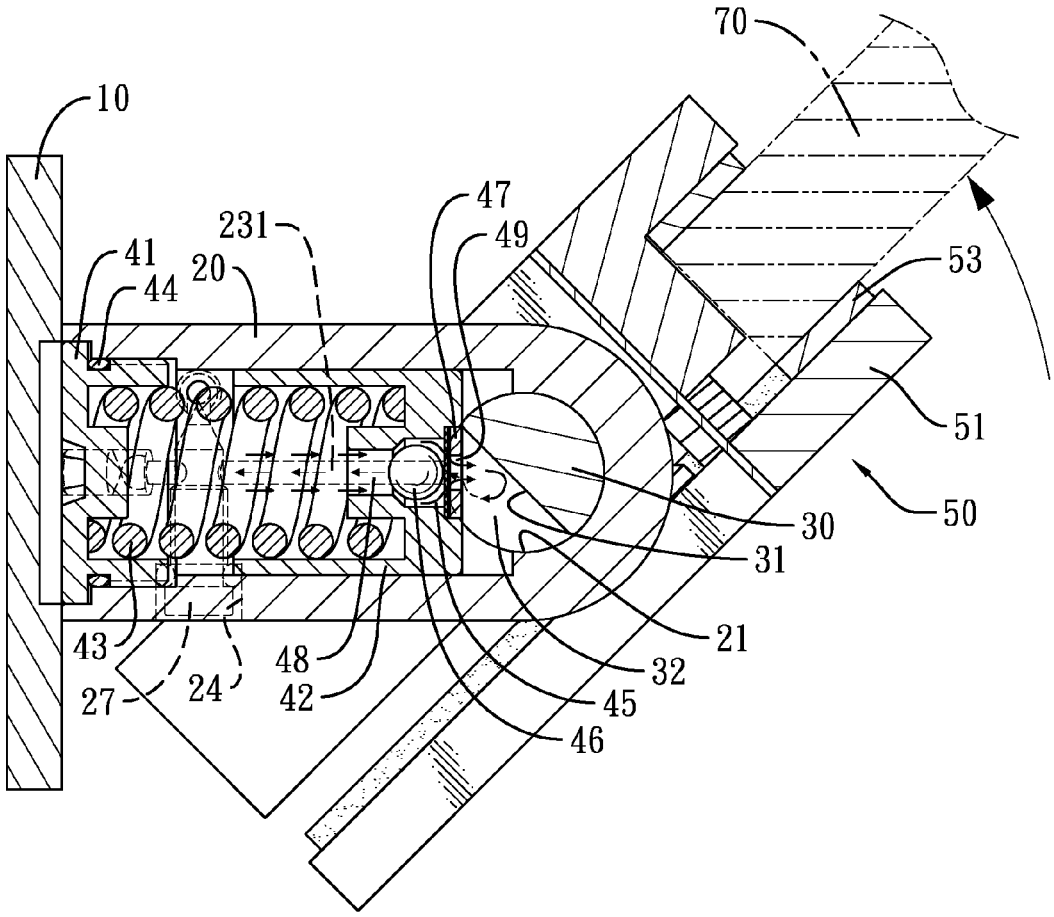
FIG. 6 is an enlarged operational top view in partial section of the hydraulic hinge in FIG. 1.

With reference to FIG. 6, the glass door 70 is pivoted relative to the base 20 and is in an open situation, which means an angle between the glass door 70 and the base 20 is less than 180 degrees and more than 90 degrees. When the glass door 70 is pivoted relative to the base 20, the pivot 30 is rotated, and then the pivot 30 contacts the sliding tube 42 aligned in a line, and the pivot 30 presses the sliding tube 42 to slide towards the fixed cover 41. The spring 43 is compressed and a space between the fixed cover 41 and the sliding tube 42 is reduced gradually, such that the oil in the space between the fixed cover 41 and the sliding tube 42 flows in the tube hole 48 to push the ball 46, and then the oil flows across the plate hole 49 and into the adjusting space 32. The oil in the adjusting space 32 further flows into the first passage 231.

Figure 7:
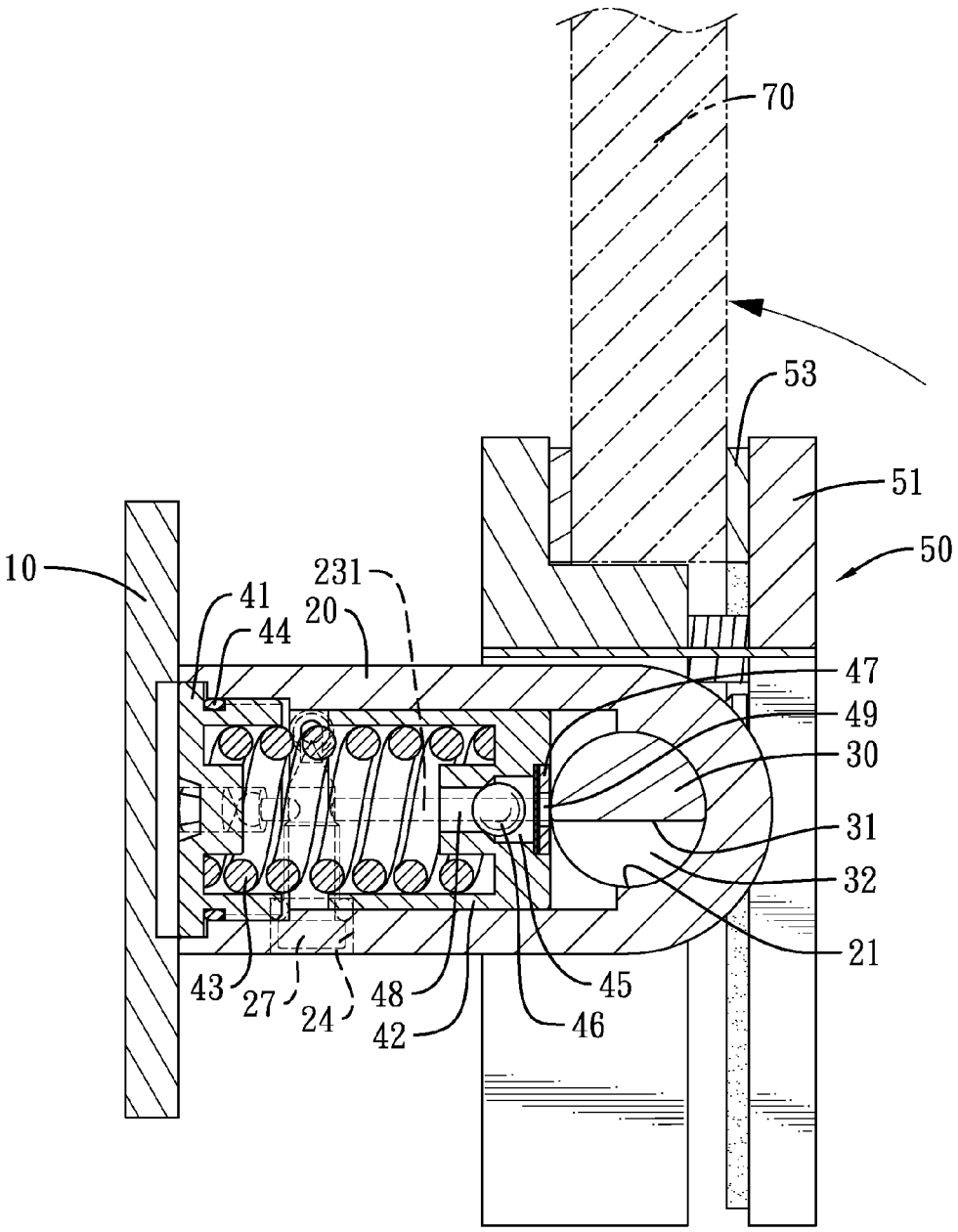
FIG. 7 is an enlarged operational top view in partial section of the hydraulic hinge in FIG. 1.

With reference to FIG. 7, when the angle between the glass door 70 and the base is 90 degrees, the glass door 70 is in a fully open condition. An elastic force of the spring 43 presses the sliding tube 42 to push the sliding tube 42 to move towards the pivot 30.

Figure 8:
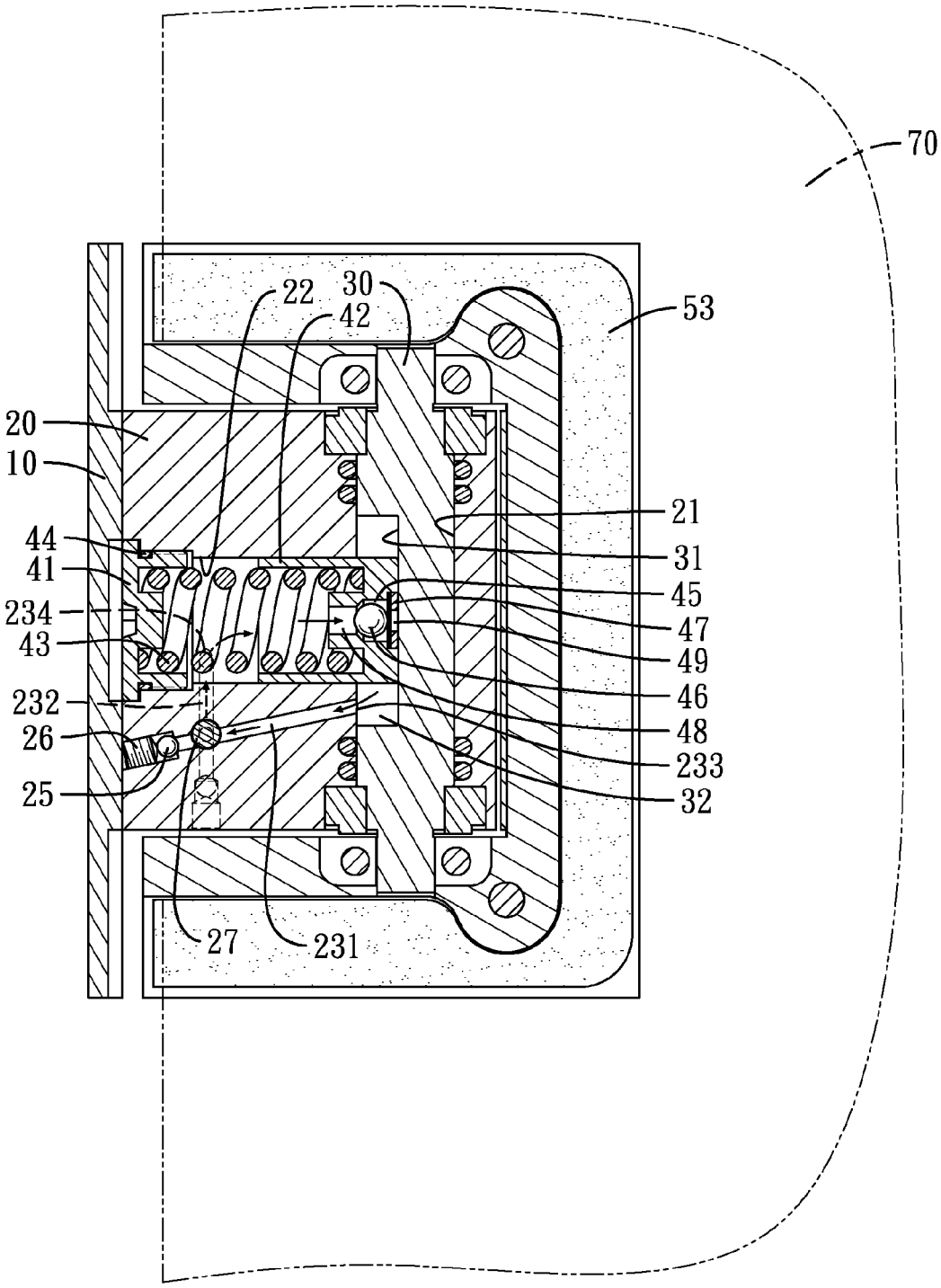
FIG. 8 is an operational left side view in partial section of the hydraulic hinge in FIG. 1.

With reference to FIG. 8, the sliding tube 42 pushes the pivot 30 to rotate to make the abutted surface 31 turn to face the fixed cover 41. In the moving process of the sliding tube 42, the space between the sliding tube 42 and the fixed cover 41 becomes larger gradually, such that the oil in the first passage 231 flows into the second passage 232, and then flows into the second space 22 through the second space opening 234 to fill the space between the sliding tube 42 and the fixed cover 41. When the abutted surface 31 abuts the sliding tube 42 again, the plate hole 49 is sealed by the abutted surface 31, and the oil in the second space 22 stops flowing into the adjusting space 32, such that the glass door 70 is in the closed condition, which means the hydraulic hinge is in the condition as shown in FIG. 3.

The buffer module 40 can control the abutted surface 31 to return to face the fixed cover 41, and the oil flows in the oil passage 23 can further provide a lubricating-buffering effect. As a result, the glass door 70 can be closed in a slow and smooth movement.

With reference to FIG. 5, the adjusting unit 27 can be moved in the adjusting hole 24 to adjust the size of the space in which the oil flows. Preferably, when the adjusting unit 27 is screwed out of the adjusting hole 24, the size of the space in which the oil flows is the sum of the adjusting space 32, the second space 22, the oil passage 23 and part of the adjusting hole 24. When the adjusting unit 27 is screwed into the adjusting hole 24, the size of the space in which the oil flows is only the sum of the adjusting space 32, the second space 22, and the oil passage 23. The smaller the size of the space in which the oil flows, the faster the flow speed of the oil. As a result, the flow speed of the oil can be controlled by adjusting the size of the space in which the oil flows. The adjusting unit 27 can be adjusted outside the base 20 without disassembling the glass door 70, enhancing the convenience for use.

Figure 9:
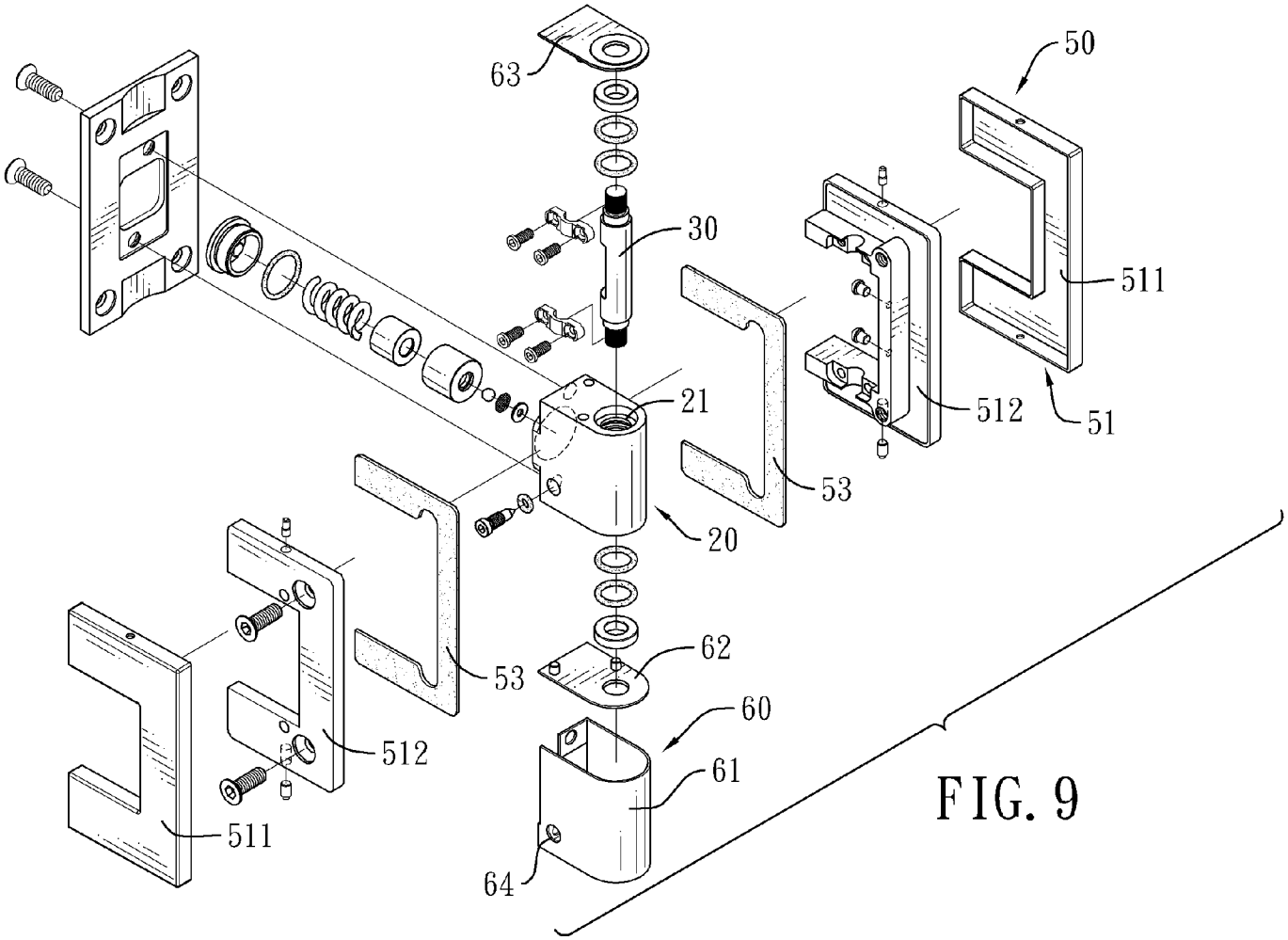
FIG. 9 is an exploded perspective view of a second preferred embodiment of a hydraulic hinge for a glass door in accordance with the present invention.
Figure 10:
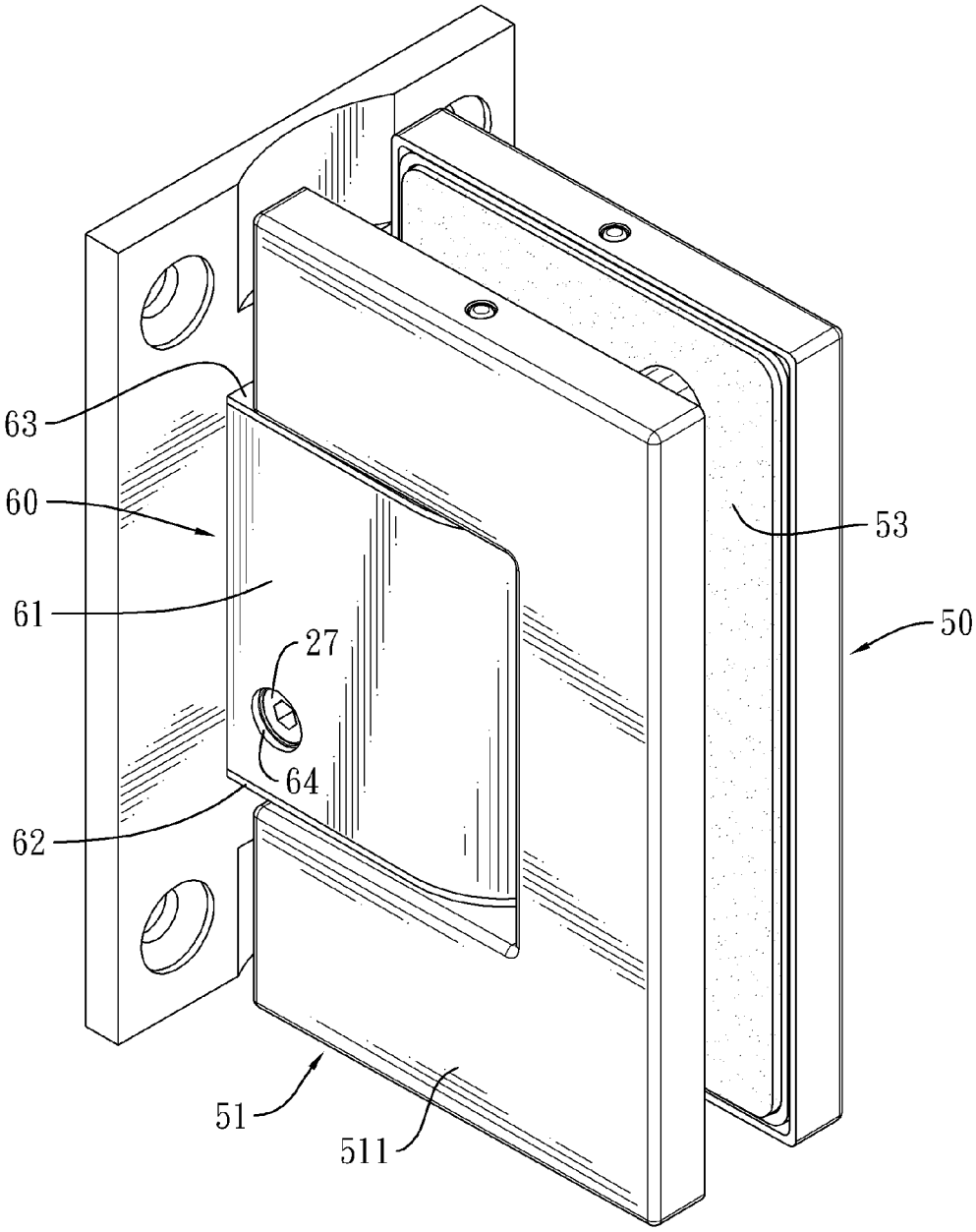
FIG. 10 is a perspective view of the hydraulic hinge in FIG. 9.

With reference to FIG. 9 and FIG. 10, the hydraulic hinge of a second preferred embodiment in accordance with the present invention further has a base shell 60. The base shell 60 is made of stainless steel and is mounted outside the base 20 to provide an antirust effect for the base 20. The base shell 60 has a shell body 61, a first cover 62, a second cover 63 and an aligning hole 64. The shell body 61 is sleeved around the base 20 along the longitudinal direction of the first space 21, and the first cover 62 and the second cover 63 are combined with the base 20 at the opposite ends respectively. The aligning hole 64 is formed through the shell body 61 and corresponds to the adjusting unit 27 in position to expose the adjusting unit 27 from the aligning hole 64. Each clamping plate 51 has a plate shell 511 and a plate body 512, wherein the plate body 512 is mounted in and combined with the plate shell 511. Each plate shell 511 is made of stainless steel to provide an antirust effect. The clamping plates 51 are pivotally connected with the pivot 30 by one of the plate bodies 512, and the clamping plate 51 abuts the clamping pad 53 by the plate body 512. As a result, the base 20 does not need to be made of stainless steel since the base shell 60 is made of stainless steel, and only each clamping shell 511, not the clamping plate 51, is made of steel, such that the base 20 and the plate body 512 can be made of aluminum or other low-cost metal, reducing the manufacturing cost for the hydraulic hinge.

What is claimed is:

1. A hydraulic hinge for a glass door comprising:
- a fixing plate;
- a base combined with the fixing plate and having
  - a top side;
  - a bottom side;
  - a front side;
  - a rear side;
  - a right side;
  - a left side;
  - a longitudinal direction defined from the top side to the bottom side;
  - a lateral direction defined from the front side to the rear side;
  - a first space formed in the base along the longitudinal direction;
  - a second space formed in the base along the lateral direction and communicating with the first space;
  - an oil passage formed in the base and communicating with the first space and the second space and having
    - a first passage formed in the base and communicating with the first space; and
    - a second passage formed in the base and communicating with the first passage and the second space; and
  - an adjusting hole formed in one of the right side and the left side of the base and communicating with the first passage and the second passage of the oil passage; and
  - an adjusting unit moveably mounted in the adjusting hole;
- a pivot rotatably mounted in the first space and having
  - a side;
  - an abutted surface formed in the pivot; and
  - an adjusting space formed in the side of the pivot and adjacent to the abutted surface and communicating with the first passage of the oil passage;
- a buffer module mounted in the second space and having
  - a fixed cover mounted in and sealing the second space and adjacent to the fixing plate;
  - a sliding tube slidably mounted in the second space and abutting the pivot and having
    - an end abutting the pivot;
    - an assembling portion formed in the end of the sliding tube, the assembling portion abutting the pivot and selectively communicating between the second space and the adjusting space;
    - a spring mounted between and abutting the fixed cover and the sliding tube;
- a clamping module pivotally mounted on the pivot and having
  - two clamping plates pivotally and respectively mounted on the right side and the left side of the base; and
- a shell body made of stainless steel, mounted outside the base and having an aligning hole formed through the shell body and corresponding to the adjusting unit in position to expose the adjusting unit from the aligning hole.

2. The hydraulic hinge as claimed in claim 1, wherein the assembling portion further has
- a tube hole formed in the assembling portion and communicating with the second space and the adjusting space;
  - a ball moveably mounted in and selectively sealing the tube hole;
- a filtering plate mounted in the tube hole and selectively abutting the pivot; and
- a plate hole formed in the filtering plate and aligned with the tube hole.

3. The hydraulic hinge as claimed in claim 2, wherein the clamping module further has two clamping pads mounted on the clamping plates respectively.

4. The hydraulic hinge as claimed in claim 3, wherein the buffer module further has a sealing ring mounted around the fixed cover.

5. The hydraulic hinge as claimed in claim 1, wherein each clamping plate has
- a plate shell made of stainless steel; and
- a plate body mounted in and combined with the plate shell; wherein the clamping plates are pivotally mounted on the pivot by one of the plate bodies.

6. The hydraulic hinge as claimed in claim 2, wherein each clamping plate has a plate shell made of stainless steel; and a plate body mounted in and combined with the plate shell; wherein the clamping plates are pivotally mounted on the pivot by one of the plate bodies.

7. The hydraulic hinge as claimed in claim 3, wherein each clamping plate has a plate shell made of stainless steel; and a plate body mounted in and combined with the plate shell; wherein the clamping plates are pivotally mounted on the pivot by one of the plate bodies.

8. The hydraulic hinge as claimed in claim 4, wherein each clamping plate has a plate shell made of stainless steel; and a plate body mounted in and combined with the plate shell; wherein the clamping plates are pivotally mounted on the pivot by one of the plate bodies.

* * * * *